US008342826B2

(12) United States Patent
Fujita et al.

(10) Patent No.: US 8,342,826 B2
(45) Date of Patent: Jan. 1, 2013

(54) VARIABLE CAPACITY VANE PUMP

(75) Inventors: Tomoyuki Fujita, Tokyo (JP); Masamichi Sugihara, Tokyo (JP); Hiroshi Shiozaki, Tokyo (JP); Koichiro Akatsuka, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 642 days.

(21) Appl. No.: 12/461,333

(22) Filed: Aug. 7, 2009

(65) Prior Publication Data

US 2010/0034681 A1 Feb. 11, 2010

(30) Foreign Application Priority Data

Aug. 8, 2008 (JP) ..... 2008-205258

(51) Int. Cl.
*F03C 4/00* (2006.01)
*F04C 14/18* (2006.01)
*F04C 2/00* (2006.01)

(52) U.S. Cl. ..... 418/26; 418/30; 418/133; 418/260; 418/270

(58) Field of Classification Search ..... 418/23–30, 418/133, 259–260, 270; 417/220, 213
See application file for complete search history.

(56) References Cited

U.S. PATENT DOCUMENTS

| | | | | |
|---|---|---|---|---|
| 5,690,479 | A * | 11/1997 | Lehmann et al. | 418/26 |
| 6,688,862 | B2 * | 2/2004 | Jeronymo et al. | 418/26 |
| 6,913,446 | B2 * | 7/2005 | Nissen et al. | 418/30 |

FOREIGN PATENT DOCUMENTS

| | | | | |
|---|---|---|---|---|
| GB | 2232208 | A * | 12/1990 | 418/30 |
| JP | 60053688 | A * | 3/1985 | 418/26 |
| JP | 2002-206490 | | 7/2002 | |
| JP | 2004-150442 | A | 5/2004 | |
| JP | 2007-32517 | | 2/2007 | |
| JP | 2008-111362 | | 5/2008 | |
| JP | 2008-115706 | | 5/2008 | |

* cited by examiner

*Primary Examiner* — Theresa Trieu
(74) *Attorney, Agent, or Firm* — Rabin & Berdo, P.C.

(57) ABSTRACT

A variable capacity vane pump (100) has a pump housing (10) having a high-load bearing part (10*a*) on which a higher load is exerted than another part when the pump vane pump (100) operates. A control valve (21) for varying a capacity of the vane pump (100) is provided in a valve housing (28) which is formed integrally in the pump housing (10). By arranging the valve housing (28) on the same side of the pump housing (10) as the high-load bearing part (10*a*) with respect to the rotation axis of the vane pump (100), the high-load bearing part (10*a*) can be reinforced without increasing the size of the vane pump (100).

5 Claims, 3 Drawing Sheets

VARIABLE CAPACITY VANE PUMP

FIELD OF THE INVENTION

This invention relates to a variable capacity vane pump which is for example, mounted on a vehicle as an oil pressure source.

BACKGROUND OF THE INVENTION

A hydraulic pressure source mounted on a vehicle is constituted, for example, by a variable capacity vane pump.

JP2004-150442A published in 2004 by the Japan Patent Office discloses a variable capacity vane pump of this kind. This prior art variable capacity vane pump comprises a control valve which controls a hydraulic pressure used for varying the capacity of pump chambers. The control valve is accommodated in a valve housing which is formed integrally in the pump housing.

The pump housing comprises a high-load bearing part surrounding contracting pump chambers and a low-load bearing part surrounding enlarging pump chambers. The control valve housing is formed in the low-load bearing part.

SUMMARY OF THE INVENTION

When the variable capacity vane pump operates, the high-load bearing part bears a high load corresponding to the high pressure in the contracting pump chambers. The load is transmitted from the pump chambers to the high-load bearing part via a cam ring facing the pump chambers and a pin which supports the cam ring on the pump housing. If this high load becomes excessively large, the pump housing may generate vibration or noise.

To prevent vibration or noise from being generated in the pump housing, the high-load bearing part must be reinforced to have a sufficient rigidity against the high load exerted from the high-pressure pump chambers. Reinforcing the high-load bearing part is generally performed by increasing a wall thickness of the high-load bearing part, but it inevitably brings about an increase in the size of the variable capacity vane pump.

It is therefore an object of this invention to reinforce a high-load bearing part of a pump housing of a variable capacity vane pump without increasing the size.

To achieve the above object, this invention provides a variable capacity vane pump having a rotation axis, comprising a pump housing comprising a high-load bearing part on which a higher load is exerted than another part when the vane pump operates, a control valve which regulates a pressure supplied to the vane pump for varying a capacity thereof, and a valve housing which is formed in the pump housing on an identical side of the high-load bearing part with respect to the rotation axis to accommodate the control valve.

The details as well as other features and advantages of this invention are set forth in the remainder of the specification and are shown in the accompanying drawings.

DESCRIPTION OF THE PREFERRED EMBODIMENTS

Preceding the description of a variable capacity vane pump according to this invention, a variable capacity vane pump 1000 according to the prior art will be described.

Figure 3:
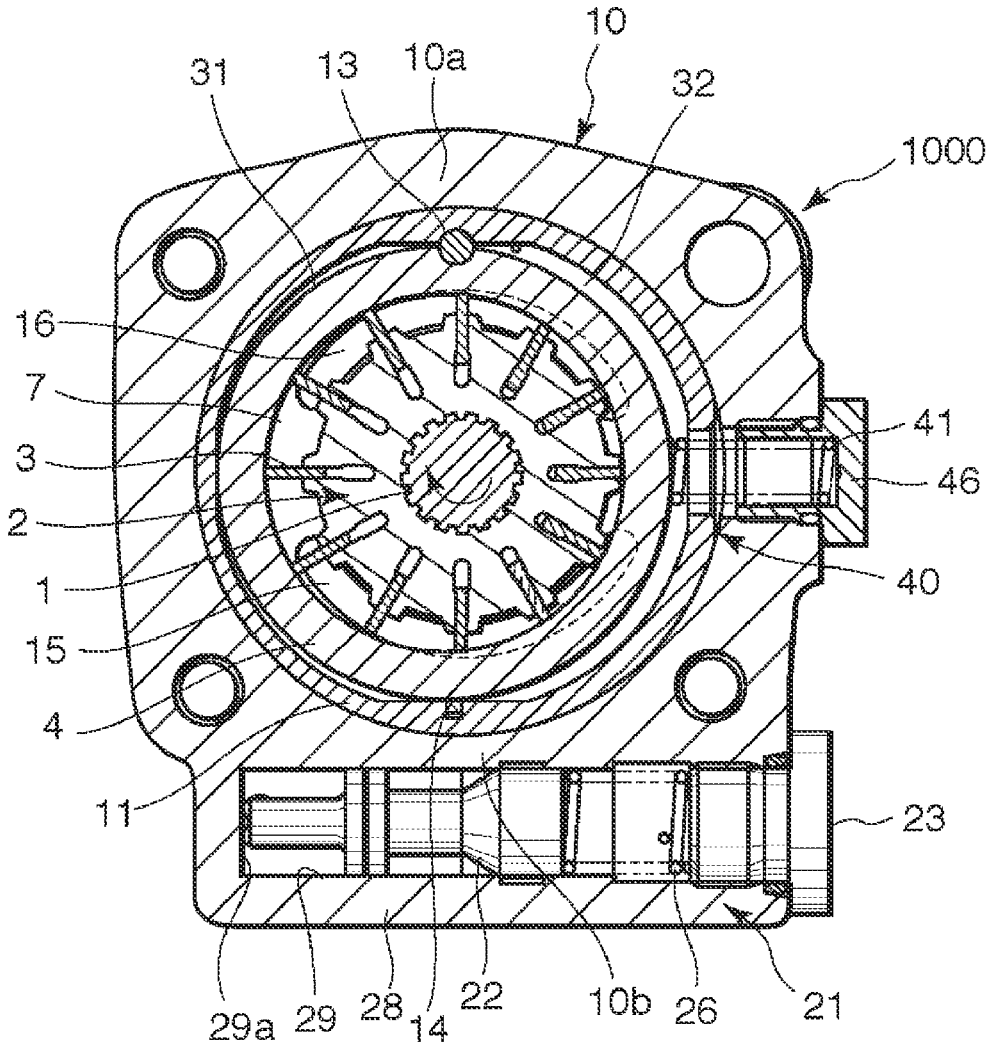
PRIOR ART FIG. 3
FIG. 3 is a cross-sectional view of a variable capacity vane pump according to the prior art.

Referring to FIG. 3 of the drawings, a variable capacity vane pump 1000 according to the prior art comprises a rotor 2 accommodated in a cam ring 4. The rotor 2 is formed in a cylindrical shape having a center axis. The rotor 2 is driven by a motive source via a drive shaft 1 and rotates about the center axis. The center axis of the rotor 2 is also referred to as a rotation axis of the variable capacity vane pump 1000.

The rotor 2 is provided with a plurality of vanes 3 disposed at equal angular intervals on an outer periphery of the rotor 2. Each of the vanes 3 protrudes radially from the outer periphery of the rotor 2 towards the cam ring 4, and a protruding tip of each vane 3 is in contact with an inner periphery of the cam ring 4.

A plurality of pump chambers 7 are thus formed in the cam ring 4 by the vanes 3 and the rotor 2.

Two axial ends of the pump chambers 7 are closed by end plates fixed in the pump housing 10, respectively. One end plate is provided with a suction port 15 and a discharge port 16.

Since the cam ring 4 is located eccentric to the rotor 2, the vanes 4 elongate and contract within the cam ring 4 according to a rotation position of the rotor 2, and the pump chambers 7 delimited by the vanes 3 expand and contract accordingly.

In the figure, when the rotor 2 rotates in a direction designated by an arrow, the pump chambers 7 located on the outer periphery of the upper half of the rotor 2 contract while the pump chambers 7 located on the outer periphery of the lower half of the rotor 2 expand.

The suction port 15 is formed through the end plate to face the expanding pump chambers 7 and the discharge port 16 is formed through the end plate to face the contracting pump chambers 7. As the rotor 2 rotates, the expanding pump chambers 7 shift toward the contracting pump chambers 7 while the contracting pump chambers 7 shift toward the expanding pump chambers 7. In other words, the pump chambers 7 undergo expand and contract one after the other as the rotor 2 rotates by 360 degrees. Accompanying this action, the vane pump 1000 aspirates working oil into the expanding pump chambers 7 via the suction port 15, and pressurizes and discharges the working oil from the contracting chambers 7 via the discharge port 16.

In the following description, the contracting pump chambers 7 are also referred to as high-pressure pump chambers 7 and the enlarging pump chambers 7 are also referred to as low-pressure pump chambers 7.

The cam ring 4 is supported in a ring-shaped adapter 11 which is fitted into an inner periphery of a pump housing 10. The cam ring 4 is engaged with a pin 13 disposed in parallel with the center axis of the rotor 2. The ring-shaped adapter 11 and the cam ring 4 are provided with grooves extending in parallel with the center axis of the rotor 2. The grooves are formed in the crown part of the ring-shaped adapter 11 and the cam ring 4 to face each other, and the pin 13 is fitted in these grooves. The outer periphery of the cam ring 4 contacts the inner periphery of the ring-shaped adapter 11 at a point opposite to the pin 13. A seal member 14 is provided in this point of contact.

By varying the relative position of the cam ring 4 to the rotor 2, or in other words the eccentricity of the cam ring 4 relative to the rotor 2, the difference in the capacity of the pump chambers 7 increases or decreases, and hence the discharge flow rate, or the capacity of the vane pump 1000, is varied.

To vary the relative position of the cam ring 4 to the rotor 2, a first operating chamber 31 and a second operating chamber 32 are formed in the pump housing 10 on the outside of the cam ring 4. The operating chambers 31 and 32 are separated from each other by the pin 13 and the seal member 14.

The vane pump 1000 further comprises a spring 41 which biases the cam ring 4 in a direction for causing the first operating chamber 31 to contract while causing the second operating chamber 32 to expand, or in other words leftward in the figure. The spring 41 is supported by a plug 46 which is screwed into the pump housing 10. The position of the cam ring 4 in the figure is the position in which the eccentricity of the cam ring 4 relative to the rotor 2 is at a maximum and the capacity of the vane pump 1000 is at a maximum.

By increasing the pressure in the first operating chamber 31, the cam ring moves rightward in the figure against the biasing force of the spring 41, and the capacity of the vane pump 1000 decreases.

A control valve 21 is provided at the bottom of the pump housing 10 under the low-pressure pump chambers 7. The control valve 21 comprises a spool 22 accommodated in a valve hole 29 formed in the pump housing 10. The valve hole 29 is closed by a plug 23 which is screwed into the pump housing 10.

A spring 26 is interposed between the spool 22 and the plug 23 to bias the spool 22 towards a bottom 29*a* of the valve hole 29. Both end faces of the spool 22 are subjected to oil pressures and by increasing an oil pressure acting on the left end face of the spool 22, the spool 22 moves rightward in the figure against the biasing force of the spring 26.

The oil pressure acting on the right end face of the spool 22 is led from a downstream side of an orifice provided in a discharge passage of the vane pump 1000. The oil pressure acting on the left end face of the spool 22 is led from an upstream side of the orifice in the discharge passage.

When the rotor 2 rotates at a low speed, the differential pressure between the upstream side and the downstream side of the orifice is small, and hence the spool 22 stays in the position shown in the figure with the left end face contacting the bottom 29*a* of the valve hole 29. In this state, as mentioned above, the vane pump 1000 maintains a maximum capacity such that a required discharge flow rate is satisfied.

As the discharge flow rate of the vane pump 1000 increases beyond a predetermined flow rate, the differential pressure between the upstream side and the downstream side of the orifice exceeds a predetermined differential pressure, and the spool 22 begins to move rightward in the figure against the biasing force of the spring 26.

The control valve 21 is configured to connect the first operating chamber 31 to the discharge port 16 while connecting the suction port 15 to a drain as the spool 22 moves rightward in the figure. As a result, the cam ring 4 moves rightward against the spring 41 and the capacity of the vane pump 1000 decreases so as to prevent the discharge flow rate of the vane pump 1000 from becoming excessive.

In this vane pump 1000, the valve hole 29 is disposed orthogonal to the center axis of the rotor 2 at the bottom part 10*b* of the pump housing 10 on the outside of the low-pressure pump chambers 7. A part of the pump housing 10 surrounding the valve hole 29 is referred to as a valve housing 28.

A pressure in the low-pressure pump chambers 7 is transmitted to a lower part of the pump housing 10, in which the valve housing 28 is formed, via the cam ring 4 and the ring-shaped adapter 11. A pressure in the high-pressure pump chambers 7 is transmitted to an upper part of the pump housing 10 via the cam ring 4, the pin 13, and the ring-shaped adapter 11.

The upper part of the pump housing 10 therefore bears a high load when the vane pump 1000 operates. This part is referred to as a high-load bearing part 10*a* whereas the lower part of the pump housing 10 is referred to as a low-load bearing part 10*b*.

In order to assure the structural strength of the high-load bearing part 10*a*, the wall thickness of this part must be made thick. As a result, the pump housing 10 inevitably grows in size.

The gist of this invention is to reinforce the high-load bearing part of a pump housing without increasing the size of a variable capacity vane pump.

Figure 1:
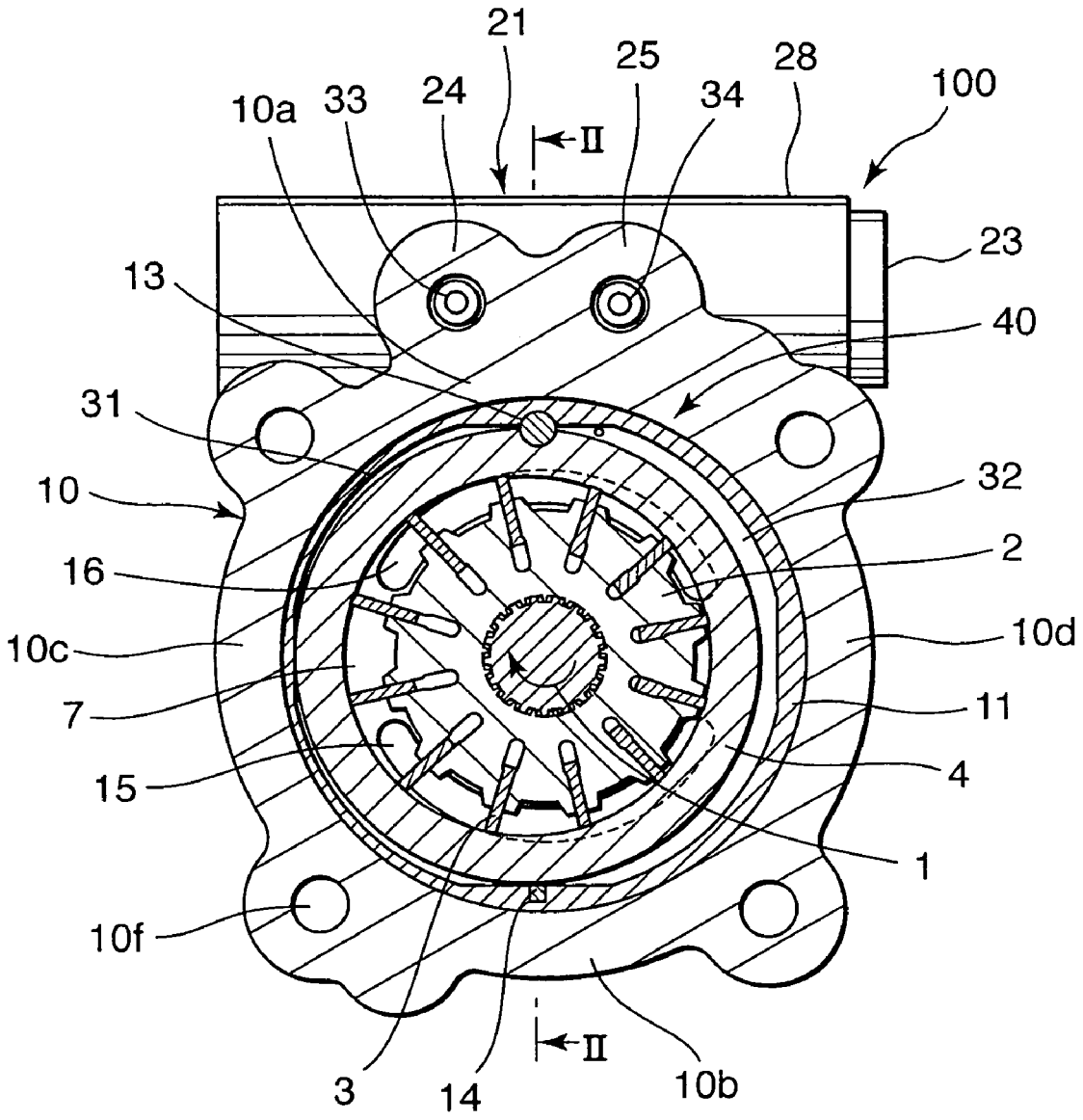
FIG. 1 is a cross-sectional view of a variable capacity vane pump according to this invention.
Figure 2:
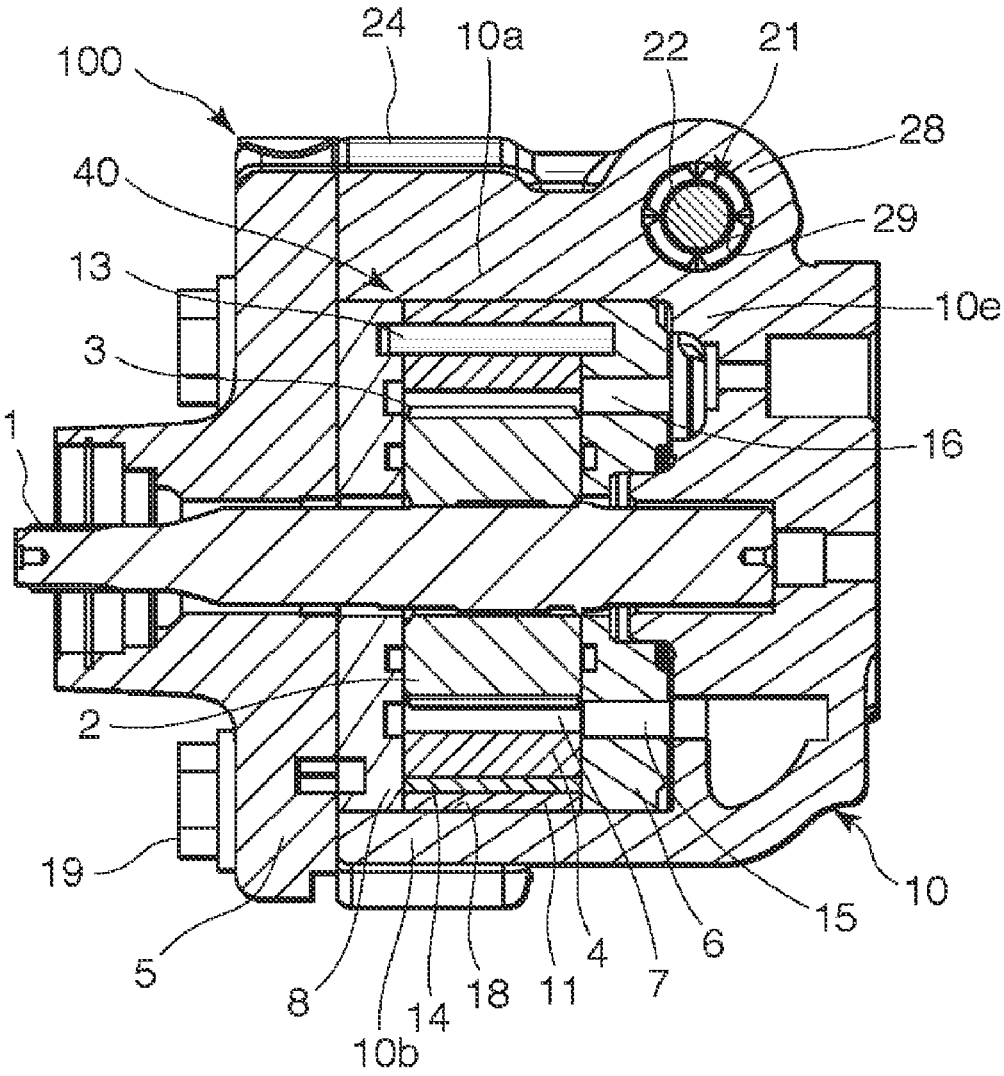
FIG. 2 is a longitudinal sectional view of the variable capacity vane pump taken along a line II-II of FIG. 1.

Referring to FIGS. 1 and 2, a variable capacity vane pump 100 according to this invention will now be described.

The components of the vane pump 100 that have the same construction as those of the prior art vane pump 1000 are given identical component numbers, and their description is herein omitted.

Referring to FIG. 2, the pump housing 10 of the vane pump 100 has a pump bore 18 in the shape of a cylinder having a bottom part 10*e*. An opening of the pump bore 18 is closed by a pump cover 5.

Referring to FIG. 1, four bolt holes 10*f* are formed in the pump housing 10. Four bolts 19 passing though the pump cover 5 are screwed into the bolt holes 10*f*, respectively.

Referring again to FIG. 2, the rotor 2, the cam ring 4 and the ring-shaped adaptor 11 are housed in the pump bore 18 between a pair of end plates 6 and 8 fixed in the pump bore 18. The suction port 15 having an arc shape is formed through the end plate 6, and working oil is aspirated into the low-pressure pump chambers 7 via this suction port 15. The discharge port 16 in an arc-shape is formed through the end plate 6, and the working oil pressurized in the high-pressure pump chambers 7 is discharged therefrom via this discharge port 16.

The pump housing 10 comprises the high-load bearing part 10*a*, the low-load bearing part 10*b*, a pair of side wall parts 10*c*, 10*d*, and a bottom part 10*e* forming the bottom of the pump bore 18.

The valve housing 28 of the control valve 21 is formed in the pump housing 10 on the same side of the high-load bearing part 10*a* with respect to the center axis of the rotor 2, or the rotation axis of the vane pump 100. The valve hole 29 is formed in the valve housing 28, and the spool 22 is accommodated in the valve hole 29 as in the case of the prior art vane pump 1000. The pump chambers 7 are delimited by the rotor 2, the vanes 3, the cam ring 4, and the pair of end plates 6 and 8. The length of the pump chambers 7 in the direction of the center axis of the rotor 2 is identical to the length of the rotor 2 and the cam ring 4, as shown in FIG. 2.

The valve housing 28 is formed integrally in the high-load bearing part 10*a* of the pump housing 10 so as to be orthogonal to the center axis of the rotor 2 at a position offset from the high-pressure pump chambers 7 in the direction of the center axis of the rotor 2. This offset position is adjacent to the bottom part 10*e* of the pump housing 10.

A pair of reinforcing ribs 24 and 25 are formed on the top of the pump housing 10 as a part of the high-load bearing part 10*a*. Each of the reinforcing ribs 24 and 25 is formed in a cylindrical shape. The reinforcing ribs 24 and 25 are disposed adjacent to each other in parallel with the center axis of the rotor 2. The reinforcing ribs 24 and 25 bulge upward, but their height is not higher than the height of the valve housing 28.

A first fluid passage 33 is formed through the reinforcing rib 24 and a second fluid passage 34 is formed through the reinforcing rib 25. The first fluid passage 33 connects the control valve 21 and the first operating chamber 31. The second fluid passage 34 connects the control valve 21 and the second operating chamber 32. The first fluid passage 33 and the second fluid passage 34 penetrate another part of the pump housing 10, the pump cover 5, and the side plate 8 to establish these connections.

The cam ring 4 displaces according to the differential pressure between the first operating chamber 31 and the second operating chamber 32. It should be noted that the spring 41 biasing the cam ring 4 in FIG. 3 is omitted from this vane pump 100.

In this vane pump 10 also, the pressure in the high-pressure pump chambers 7 exerts a high load on the high-load bearing part 10*a* via the cam ring 4, the pin 13, and the ring-shaped adaptor 11.

Since the high-load bearing part 10*a* is reinforced by the reinforcing ribs 24 and 25 in this vane pump 100, the high load is supported firmly by the high-load bearing part 10*a* without generating vibration or noise.

Since the reinforcing ribs 24 and 25 are provided on the same side of the valve housing 28 as the high-load bearing part 10*a* with respect to the center axis of the rotor 2 in the pump housing 10, and the height of the reinforcing ribs 24 and 25 does not exceed the height of the valve housing 28 of the control valve 21, reinforcement of the high-load bearing part 10*a* can be performed without increasing the overall height of the vane pump 100.

Forming the fluid passages 33 and 34 through the reinforcing ribs 24 and 25, respectively, also helps in suppressing the overall size of the vane pump 100.

According to this variable capacity vane pump 100, the valve housing 28 of the control valve 21 is not formed in the low-load bearing part 10*b* as in the case of the prior art variable capacity vane pump 1000, and hence the low-load bearing part 10*b* can be made thinner.

The contents of Tokugan 2008-205258, with a filing date of Aug. 8, 2008 in Japan, are hereby incorporated by reference. Although the invention has been described above with reference to a certain embodiment, the invention is not limited to the embodiment described above. Modifications and variations of the embodiment described above will occur to those skilled in the art, within the scope of the claims.

For example, according to the embodiment described above, the valve housing 28 is formed at a position offset from the high-pressure pump chambers 7 in the direction of the center axis of the rotor 2 in order to dispose the reinforcing ribs 24 and 25 above the high-pressure pump chambers 7. However, this invention can be implemented by forming the valve housing 28 directly above the high-pressure pump chambers 7. In this case, the high-load bearing part 10*a* of the pump housing 10 is reinforced directly by the valve housing 28.

The variable capacity vane pump 100 may handle any incompressible fluid other than working oil.

The embodiments of this invention in which an exclusive property or privilege is claimed are defined as follows:

The embodiments of this invention in which an exclusive property or privilege is claimed are defined as follows:

1. A variable capacity vane pump having a rotation axis, comprising:

a pump housing comprising a high-load bearing part to which a higher load is exerted than another part when the vane pump operates;

a control valve which regulates a pressure supplied to the vane pump for varying a capacity thereof;

a valve housing which is formed in the pump housing on an identical side of the high-load bearing part with respect to the rotation axis to accommodate the control valve;

a rotor formed into a cylindrical body having an end face and accommodated in the pump housing, the rotor having a center axis which corresponds to the rotation axis and a plurality of vanes which protrude radially from an outer periphery thereof, each of the vanes having a protruding tip;

a cam ring that is supported in the pump housing to surround the rotor in an eccentric position thereto and contacts the protruding tips of the vanes so as to form pump chambers delimited by the vanes, the pump chambers comprising high-pressure pump chambers and low-pressure pump chambers which are defined in relation to a rotation position of the rotor about the center axis;

an end plate fixed in the pump housing so as to face the end face of the rotor, the end plate having a discharge port facing the high-pressure pump chambers, wherein the higher load is derived from a pressure in the high-pressure pump chambers, the valve housing is formed in an offset position from the high-pressure pump chambers along the center axis of the rotor, the control valve comprises a valve body in a shape of a spool having an axis, and the valve housing is formed such that the axis of the control valve is orthogonal to the center axis of the rotor, and the pump housing further comprises a first reinforcing rib formed on an outer periphery of the high-load bearing part in parallel with the center axis of the rotor.

2. The variable capacity vane pump as defined in claim 1, wherein the pump housing further comprises a first operating chamber which exerts the pressure supplied from the control valve on the cam ring to vary a capacity of the vane pump by varying an eccentricity of the cam ring relative to the rotor, and a passage connecting the first operating chamber and the control valve is formed through the first reinforcing rib.

3. The variable capacity vane pump as defined in claim 2, wherein the pump housing further comprises a second operating chamber which exerts the pressure supplied from the control valve on the cam ring in an opposite direction to the first operating chamber, and a second reinforcing rib formed on the outer periphery of the high-load bearing part in parallel with the first reinforcing rib, and a passage connecting the second operating chamber and the control valve is formed through the second reinforcing rib.

4. The variable capacity vane pump as defined in claim 3, wherein the cam ring is supported in the pump housing via a pin disposed in parallel with the center axis of the rotor, the pin is engaged with an inner periphery of the pump housing and an outer periphery of the cam ring, the cam ring contacts the inner periphery of the pump housing on the opposite side of the outer periphery to the pin via a seal member, and the first and second operating chambers are delimited by the pin, the seal member, and the outer periphery of the cam ring in the pump housing.

5. The variable capacity vane pump as defined in claim 1, wherein the end plate further has a suction port facing the low-pressure pump chambers.

* * * * *